US009972183B2

(12) United States Patent
Sheflin et al.

(10) Patent No.: US 9,972,183 B2
(45) **Date of Patent: *May 15, 2018**

(54) SYSTEM AND METHOD OF MOTION DETECTION AND SECONDARY MEASUREMENTS

(71) Applicant: Honeywell International Inc., Morristown, NJ (US)

(72) Inventors: Daniel J. Sheflin, Ponce Inlet, FL (US); Kenneth L. Addy, Massapequa, NY (US); Aravind Padmanabhan, Plymouth, MN (US)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/368,901

(22) Filed: Dec. 5, 2016

(65) Prior Publication Data

US 2017/0084148 A1 Mar. 23, 2017

Related U.S. Application Data

(63) Continuation of application No. 14/293,517, filed on Jun. 2, 2014, now Pat. No. 9,536,406.

(51) Int. Cl.

| | |
|---|---|
| ***G08B 1/08*** | (2006.01) |
| ***G08B 19/00*** | (2006.01) |
| ***G08B 13/24*** | (2006.01) |
| ***G08B 25/10*** | (2006.01) |

(52) U.S. Cl.

CPC ..... *G08B 19/00* (2013.01); *G08B 1/08* (2013.01); *G08B 13/2494* (2013.01); *G08B 25/10* (2013.01)

(58) Field of Classification Search

CPC ..... G08B 25/00; G08B 21/22; G08B 29/16
USPC ..... 340/539.22, 541, 545.1, 545.2, 565
See application file for complete search history.

(56) References Cited

U.S. PATENT DOCUMENTS

| | | | | |
|---|---|---|---|---|
| 8,955,022 | B2 | 2/2015 | Poder et al. | |
| 9,007,222 | B2 | 4/2015 | Mittleman et al. | |
| 9,536,406 | B2 * | 1/2017 | Sheflin | G08B 19/00 |
| 2006/0267756 | A1 | 11/2006 | Kates | |
| 2009/0051528 | A1 | 2/2009 | Graichen | |
| 2013/0049978 | A1 | 2/2013 | Piel et al. | |
| 2014/0266674 | A1 | 9/2014 | Nye et al. | |

FOREIGN PATENT DOCUMENTS

WO WO 2013/134892 A1 9/2013

OTHER PUBLICATIONS

Extended European Search Report, dated Nov. 9, 2015, corresponding to European Application No. EP 15 16 7233.

* cited by examiner

*Primary Examiner* — Toan N Pham
(74) *Attorney, Agent, or Firm* — Husch Blackwell LLP

(57) ABSTRACT

Systems and methods of using secondary measurements to make a system-based determination are provided. Some methods can include a transceiver device receiving a first signal from at least one system-based device, the transceiver device receiving a second signal from at least one non-system device, and control circuits coupled to the transceiver device making a system-based determination responsive to both the first signal and the second signal.

20 Claims, 1 Drawing Sheet

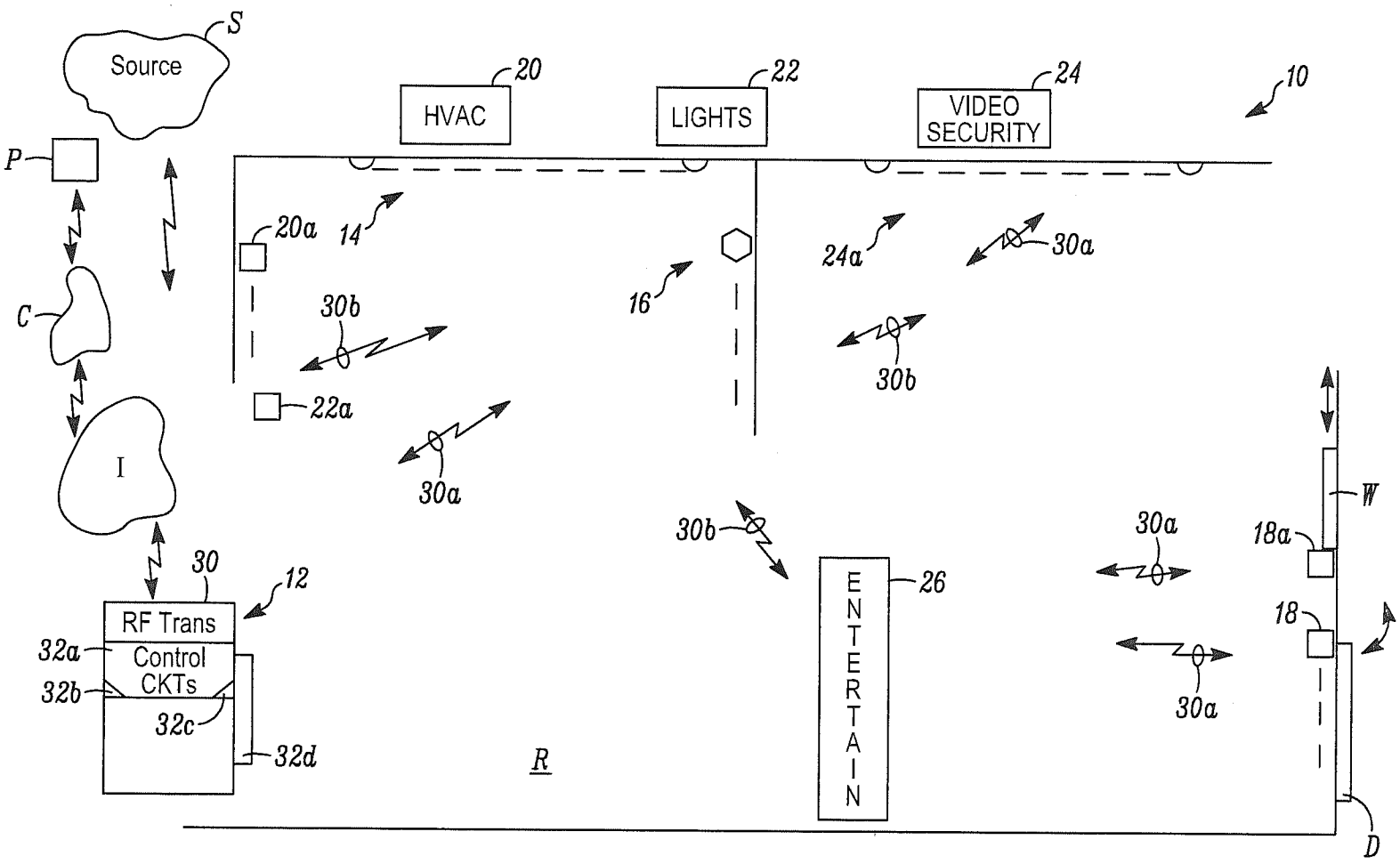
10
VIDEO SECURITY
24
LIGHTS
22
HVAC
20
24a
30a
30b
16
14
20a
22a
W
18a
18
D
26
ENTERTAIN
R
12
30
RF Trans
Control CKTs
32a
32b
32c
32d
Source
S
P
C
I

SYSTEM AND METHOD OF MOTION DETECTION AND SECONDARY MEASUREMENTS

CROSS-REFERENCE TO RELATED APPLICATIONS

This application is a continuation of and claims the benefit of the filing date of U.S. application Ser. No. 14/293,517 filed Jun. 2, 2014, now U.S. Pat. No. 9,536,406.

FIELD

The invention pertains to monitoring systems. More particularly, the invention pertains to such systems that can monitor selected conditions in a region and can take into account local wireless traffic not part of a respective monitoring system in making a determination as to an existence of one or more predetermined conditions.

BACKGROUND

Known security monitoring systems currently make decisions based on inputs from security related detectors distributed around a building. These might include motion detectors, pressure mats, door contacts, and the like, all without limitation. Other types of signals emitted by non-system devices might contain other types of information that could be used, if accessible, advantageously by a local monitoring system.

BRIEF DESCRIPTION OF THE DRAWINGS

FIG. 1 illustrates a block diagram of a system in accordance herewith.

DETAILED DESCRIPTION

While disclosed embodiments can take many different forms, specific embodiments thereof are shown in the drawings and will be described herein in detail with the understanding that the present disclosure is to be considered as an exemplification of the principles thereof as well as the best mode of practicing the same and is not intended to limit the application or claims to the specific embodiment illustrated.

Many commercial buildings and residences contain one or more monitoring systems. Increasingly, such commercial buildings and residences include additional devices or detectors that include sensors that are not part of a security system. For example, such sensors that are not part of the security system can include a motion detector in a thermostat, a camera system in a gaming console, cameras and microphones in computers, telephones, external lighting, temperature sensors, and weather stations, all without limitation.

Such systems based on existing conditions are usually capable of energizing various types of actuators to unlock or close doors or to energize camera recording systems.

Embodiments hereof improve aspects of the operation of such systems by fusing inputs from a variety of additional sensors that may not directly be part of the security system. These additional detected inputs could improve security system determinations by providing additional inputs that can be included in a decision making process.

In accordance with the above, the reliability of a detected alarm can be improved, thereby reducing false alarms. For example, information gathered from other sensors in a building or region being monitored, such as recent historical data along with readings for several seconds after an alarm determination has been made, can be taken into account before making a decision to call first responders. In this regard, such secondary measurements or information could be "weighted" and combined to make a final decision.

In one aspect, since security systems are "always on" by nature to provide 24/7 coverage, security system processing could initiate activity on other non-security networks. To improve the QOS/reliability of wi-fi alarm messages, an alarm trigger could be used to turn off wi-fi activity from other devices in a region of interest. For example, a dongle in a USB port of a router can shut off all other traffic except streaming video from security cameras.

In another aspect, signals from non-system sources can be used as a basis for actuating security system devices, which can normally be in a low energy default state to extend useful battery life. For example, to improve battery lifetime of wireless devices, higher current battery powered devices, such as wireless cameras, can be placed into a very low current state until awakened by a signal from a device that is continuously powered.

The above requires an underlying wireless network with always-on nodes to collect and reformat messages into a protocol for synchronized "paging" of mostly-off devices. For example, a USB Tx/Rx plugged into a gaming system can detect/see human activity and, in response thereto, wake up or energize wireless cameras in other parts of a home.

Additional embodiments, without limitation, include providing control of actuators by a variety of sensors that may or may not be part of an actuation system. In this regard, a CO detector that has gone into alarm can be used to turn on air conditioning and an associated fan to rapidly refresh air in an area. Coverings, such as blinds or drapes, can be closed if a room is becoming too warm due to sunlight. Alternately, in winter, if a furnace is running, then criteria could be incorporated to automatically close the coverings to reduce heating expenses, or windows can also be locked in such conditions.

In another aspect, wirelessly controlled doors, such as z-wave operated doors, can be unlocked in an alarm event. This could prevent axe damage from first responders.

FIG. 1 illustrates a block diagram of a system 10 in accordance herewith. A region R is being monitored by a monitoring system 12. The monitoring system 12 can communicate, wired or wirelessly, with a plurality of ambient condition detectors, such as fire, smoke, or gas detectors 14, as well as with a plurality of intrusion detectors 16 that sense motion, position, or audio, all as would be understood by those of skill in the art.

The system 12 can also be in wired or wireless communications with a plurality of actuators, including door control, locking, and unlocking systems 18 for doors, such as a door D, or window locking, unlocking, opening, or closing systems 18*a* for windows W. Other types of actuators could include fans, pumps, or the like, all without limitation.

It will also be understood that other types of monitoring systems, such as heating ventilating air conditioning systems (HVAC) 20 (with one or more wireless thermostats 20*a*), lighting control systems 22 (with one or more wireless illumination sensors 22*a*), or video security imaging systems 24 (with cameras 24*a*), could also be used in the region R along with an entertainment system 26.

The monitoring system 12 can include a wireless RF transceiver 30 for wireless communications 30*a* with members of the various pluralities 14, 16, 18 that are part of the monitoring system 12. The transceiver 30 can also communicate directly 30*b* or via the Internet I with Internet-enabled members of the pluralities 14, 16, 18, 18*a*.

Other types of systems, such as the systems 20, 22, 24, 26, without limitation, in or in the vicinity of the region R are not part of the monitoring system 12. All such systems 20, 22, 24, 26 might emit wireless signals, such as 30*b*, detectable by the transceiver 30. Similarly, related wireless control units 20*a*, 22*a* could also emit detectable signals 30*b*.

The monitoring system 12 can also include control circuits 32*a* coupled to the transceiver 30. The control circuits 32*a* can be implemented, at least in part, by one or more programmable processors 32*b* along with executable instructions 32*c*. A manually operable control panel and a visual display 32*d* can be coupled to the control circuits 32*a* via a wired or wireless interface.

In summary, wired or wireless signals from those members of the pluralities 14, 16, 18 that are not part of the system 12 as well as other systems, such as 20, 22, 24, 26, and their respective wireless control units, such as 20*a*, 22*a*, can be detected by the system 12. These signals can be incorporated, as discussed above, into making alarm determinations, activating devices in a non-active state, or energizing actuators to open or close doors or windows, operate fans, turn lights on or off, enable video cameras, or the like without being part of the system 12.

In yet another aspect, units that are not part of a local system, such as the system 12, can be physically displaced from the system 12. They can include Internet-enabled sources S or cellular-type units P that can communicate via a local cell system C. In this regard, user activity in one location can, via the Internet or cellular systems, such as the system C, trigger events in a different system. For example, locking an office door at work can be communicated to a home security system, such as the system 12, to turn on heat or lights or report security system/video status back to a mobile phone, such as one of the cellular-type units P. Hence, remote as well as local event actions can be responded to by the local system, such as the system 12.

From the foregoing, it will be observed that numerous variations and modifications may be effected without departing from the spirit and scope hereof. It is to be understood that no limitation with respect to the specific apparatus illustrated herein is intended or should be inferred. It is, of course, intended to cover by the appended claims all such modifications as fall within the scope of the claims

The invention claimed is:

1. A system comprising:

a transceiver device;

a programmable processor coupled to the transceiver device; and executable control software stored on a non-transitory computer readable medium, wherein the transceiver device receives a first signal from at least one system-based device, wherein the transceiver devices receives a second signal from at least one non-system device, and wherein the programmable processor and the executable control software make a system-based determination responsive to both the first signal and the second signal.

2. The system as in claim 1 wherein the programmable processor and the executable control software making the system-based determination includes the programmable processor and the executable control software making an alarm determination, activating a non-active device or a low power device, energizing an actuator, calling a first responder, or transmitting a status message to a mobile device.

3. The system as in claim 1 wherein the at least one system-based device includes an ambient condition detector, an intrusion detector, or an actuator.

4. The system as in claim 1 wherein the at least one non-system device includes a heating ventilating air conditioning (HVAC) system device, a HVAC system control unit, a lighting control system device, a lighting control system control unit, a video security imaging system device, a video security imaging system control unit, an entertainment system device, or an entertainment system control unit.

5. The system as in claim 1 wherein the transceiver device receives the first signal wirelessly via radio frequency communication.

6. The system as in claim 1 wherein the transceiver device receives the first signal wirelessly via the Internet.

7. The system as claim 1 wherein the transceiver device receives the second signal wirelessly via the Internet or a cellular system.

8. The system of claim 1 wherein the programmable processor and the executable control software weight the second signal when combining the first signal and the second signal to make the system-based determination.

9. A method comprising:

a transceiver device receiving a first signal from at least one system-based device;

the transceiver device receiving a second signal from at least one non-system device; and control circuits coupled to the transceiver device making a system-based determination responsive to both the first signal and the second signal.

10. The method of claim 9 wherein making the system-based determination includes making an alarm determination, activating a non-active device or a low power device, energizing an actuator, calling a first responder, or transmitting a status message to a mobile device.

11. The method of claim 9 wherein receiving the first signal includes receiving the first signal from an ambient condition detector, an intrusion detector, or an actuator.

12. The method of claim 9 wherein receiving the second signal includes receiving the second signal from a heating ventilating air conditioning (HVAC) system device, a HVAC system control unit, a lighting control system device, a lighting control system control unit, a video security imaging system device, a video security imaging system control unit, an entertainment system device, or an entertainment system control unit.

13. The method of claim 9 further comprising the transceiver device receiving the first signal wirelessly via radio frequency communication.

14. The method of claim 9 further comprising the transceiver device receiving the first signal wirelessly via the Internet.

15. The method of claim 9 further comprising the transceiver device receiving the second signal wirelessly via the Internet or a cellular system.

16. The method of claim 9 further comprising the control circuits weighting the second signal when combining the first signal and the second signal to make the system-based determination.

17. A system comprising:

at least one system-based device; and a system control unit, wherein the system control unit receives a first signal from the at least one system-based device, wherein the system control unit receives a second signal from at least one non-system device, and wherein the system control unit makes a system-based determination responsive to both the first signal and the second signal.

18. The system as in claim 17 wherein the system control unit making the system-based determination includes the system control unit making an alarm determination, activating a non-active device or a low power device, energizing an actuator, calling a first responder, or transmitting a status message to a mobile device.

19. The system as in claim 17 wherein the at least one system-based device includes an ambient condition detector, an intrusion detector, or an actuator, and wherein the at least one non-system device includes a heating ventilating air conditioning (HVAC) system device, a HVAC system control unit, a lighting control system device, a lighting control system control unit, a video security imaging system device, a video security imaging system control unit, an entertainment system device, or an entertainment system control unit.

20. The system as in claim 17 wherein the system control unit weights the second signal when combining the first signal and the second signal to make the system-based determination.

* * * * *